United States Patent [19]

York

[11] Patent Number: 5,048,587

[45] Date of Patent: Sep. 17, 1991

[54] PORTABLE SCREEN DOOR INSERT

[75] Inventor: Kenneth V. York, Northville, Mich.

[73] Assignee: Kenway, Inc., Northville, Mich.

[21] Appl. No.: 267,878

[22] Filed: Nov. 7, 1988

[51] Int. Cl.[5] ..... E06B 9/00

[52] U.S. Cl. ..... 160/217; 160/105; 160/368.1

[58] Field of Search ..... 49/490, 463, 466; 160/87, 371, 105, 354, 217, 368.1

[56] References Cited

U.S. PATENT DOCUMENTS

| | | | |
|---|---|---|---|
| 2,691,193 | 10/1954 | Wissinger | 49/490 X |
| 3,083,630 | 4/1963 | Thaxton | 160/105 X |
| 4,599,825 | 7/1986 | Sixsmith | 49/466 |
| 4,682,443 | 7/1987 | Demo . | |

FOREIGN PATENT DOCUMENTS

| | | | |
|---|---|---|---|
| 132823 | 9/1947 | Australia | 160/371 |

*Primary Examiner*—Blair M. Johnson

[57] ABSTRACT

A screen door insert is disclosed that can be used in lieu of, or in combination with, a standard screen door. The insert is particularly useful for apartment dwellers who may not be provided with a screen door. The screen door insert provides security and convenience, since it cannot be easily opened and it is also easily mountable. The insert is constructed so as to be self supporting in a standard door frame. The frame of the screen door insert is foldable in half upon itself to provide for compact and easy storage.

6 Claims, 1 Drawing Sheet

PORTABLE SCREEN DOOR INSERT

BACKGROUND OF THE INVENTION

The present invention relates generally to a screen door insert that is to be used in lieu of, or in combination with, a standard screen door.

Modern apartment buildings typically include a central air conditioning system. The owner of these apartment buildings would like their tenants to keep their outer doors and windows closed when the air conditioning system is in operation. This would lower the cost of operating the air conditioning systems by minimizing the loss of cooled air going out open windows or opens doors. To achieve this goal, the managers often utilize windows that cannot be opened by the tenant. Obviously a permanently locked outer door that cannot be opened by the tenant cannot be used to keep the door shut. What apartment owners often do instead is not provide the door with a screen door. This encourages the tenant to keep the door shut since insects can fly in freely if the door is left open. The lack of a screen door affords no security to the tenant. It also saves the apartment managers the expense of having to purchase a screen door for the apartment.

This lack of a screen door is of little harm to the tenant on a very hot day or a very cold day. However, it is a problem on cool days or evenings when the tenant may like to have his door open to get a breeze into his apartment. The tenant has no practical way of correcting this problem since screen doors are quite expensive. A typical screen door is mounted on a frame that would have to be affixed to the outside portion of the outer door frame. This screen door frame would be a fixture to the apartment and its installation might be contested by the apartment owner.

Even in an apartment or a home that does has a screen door there are problems. Screen doors break easily and are quite expensive to replace. Screen doors also provide little security for the parents of a young child since the child can quickly unlatch the door and get outside. Screen doors can also be dangerous. A person could be leaning on the door, have it swing outwardly, and conceivably fall down a set of stairs.

The present invention seeks to solve the above-noted problems by disclosing a screen door insert that is portable, can be quickly inserted into a standard outer door frame and has no portions permanently affixed to the outer door frame. The screen door insert of the present invention cannot be easily opened by a child and will not swing outwardly if leaned upon. The screen door insert of the present invention can also be folded in half in order to make it smaller for more compact storage. This is especially important to a modern apartment dweller. One embodiment of the screen door insert can be mounted in its folded condition to prevent infants or pets from getting into, or out of, a certain room.

These features and others that will become obvious upon reading of the disclosure are achieved with a sturdy construction that is simple to build and is relatively inexpensive.

SUMMARY OF THE INVENTION

The present invention discloses a screen door insert that can be used by an apartment dweller whose apartment is not equipped with a screen door. The screen door insert of the present invention is also quite useful in any residence on an infrequently used doorway in lieu of or in combination with a normal screen door. The screen door insert of the present invention can be mounted on a door frame without any modification of the door frame or the original screen door frame. It is useful in this regard as a replacement or a supplement to a broken screen door.

It is also useful in any residence with more than one door as a means of encouraging use of a selected door. If a home owner wishes that a back door, for instance, be used instead of the front door the screen door will make use of the front door inconvenient and encourage use of the back door.

The screen door insert of the present invention is especially useful for the parents of small children since it is not easily opened by a young child and would make noise if opened.

A first embodiment of the screen door insert can be foled on a horizontal axis and mounted in a door frame as a child or pet barrier. This would be particularly useful in an interior door frame where it is desired to prevent access to a certain room.

A second embodiment of the screen door insert of the present invention can be folded on a vertical axis and is useful as a door in an apartment where a screen door has not been provided. It will not be as expensive as mounting an entire screen door and will not be as objectionable to the apartment manager.

The second embodiment is also useful as an inexpensive replacement to a broken screen door.

Also the screen door insert is set against the outer door frame and thus will not swing outwardly if leaned upon.

It is an object of the present invention to achieve the above goals by the use of a simple wooden, plastic or metal frame with screen material disposed on the interior of the frame. The frame of the screen door insert if foldable along a centerline for easier and more compact storage. Handles may be disposed upon one lateral wall to facilitate the mounting and removal of the screen door insert.

The frames of the screen door inserts of the present invention are preferably formed to be slightly, i.e., $\frac{1}{4}$ inch, smaller than standard door frames. A foam rubber or resilient gasket material of a small thickness, i.e., $\frac{1}{4}$ inch, is then attached to all four sides of the frames. Since there are two gasket thicknesses added to each dimension of the frame the complete screen door insert is slightly larger than the standard door frame it is to be mounted in. However, since the gaskets are resilient, a screen door insert can be squeezed into the door frame and the gaskets will expand, seal and secure the screen door insert to the frame. The screen door inserts can be made of various sizes to correspond to the standard door opening dimensions.

These and other features of the present invention are achieved by the screen door insert disclosed in the following specification and attached drawings.

DETAILED DESCRIPTION OF THE DRAWINGS

Figure 1:
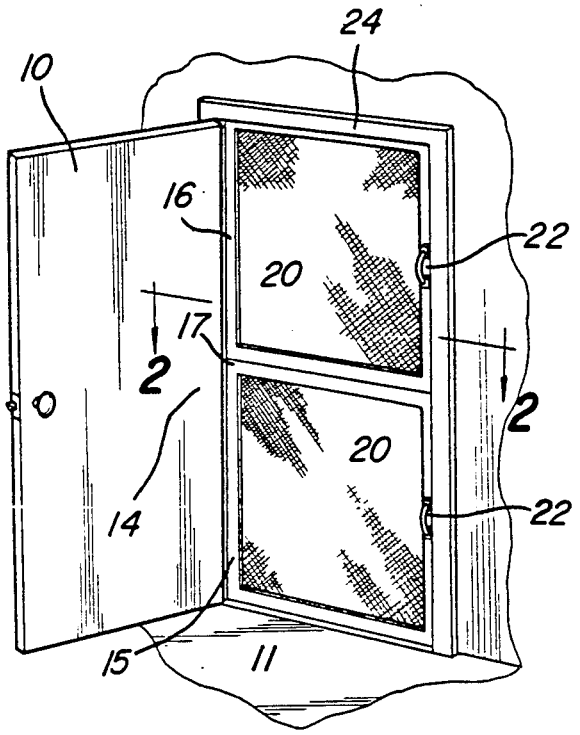
FIG. 1 is a perspective view showing the screen door insert of the present invention inserted in an outer door frame.

In FIG. 1, the screen door insert 14 of the present invention can be seen in its operably mounted position. The outer door 10 is open and the screen door insert 14 is mounted in the door frame 24. The screen door insert 14 can be seen to consist of a top frame portion 16 and a bottom frame portion 18. Each frame portion consists of two vertically extending sides, a top and a bottom. Screen material 20 fills the interior of the frames 16 and 18 and handles 22 are mounted on one vertically extending side of the screen door insert 14. The outer door 10 can be seen to open inwardly into the dwelling place 11. This is preferable for the use of the screen door insert 14 since the screen door insert rests against the door frame and provides security from uninvited entry. If the door frame opened outwardly and the screen door insert were then inserted into the door frame the person who mounted the screen door insert 14 into the door frame would have no access back into the dwelling place 11. Of course, if a second door were available into the dwelling place, the screen door insert 14 could be used with an outwardly swinging door.

Figure 2:
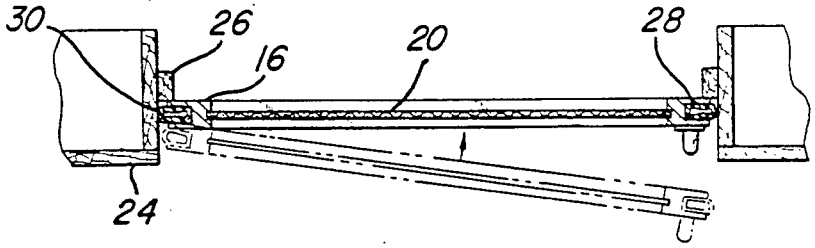
FIG. 2 is a cross-section through the screen door insert of FIG. 1 showing the structure and method of mounting the screen door insert.

FIG. 2 shows the structure and mounting of the screen door insert 14. As can be seen in FIG. 2, the disclosed embodiment of the screen door insert 14 consists of a wooden frame 16, screen material 20 disposed on the interior of the frame 16 and gasket members 28 and 30 at each end of the frame 16. The frame may also be constructed of metal, e.g. aluminum, or even plastic. In addition, other gasket members would extend along the top portion of frame members 16 and along the bottom portion of frame member 18. Thus, the screen door insert seen in FIG. 1 will have gasket material running along the top, the bottom and both vertical sides.

Door frames are of certain standard sizes. The screen door insert 14 of the present invention will be constructed so as to be usable with a certain size door frame. The wooden frame members 16 and 18 are constructed so as to be slightly smaller in both width and height than the standard door frame sizes. This clearance needs to provide enough room for the wooden frame to be easily mountable in the door frame on the one hand and yet be small enough so that the screen door insert will not be loosely mounted in the door frame. It has been found that a clearance of approximately ¼ will allow the screen door insert to be easily mounted and yet firmly secured in place.

The slight designed clearance between the dimensions of the screen door frame 14 and the standard door frame dimensions 24 is taken up by the gasket members 28 and 30. The gasket members are illustrated here as mounted in a groove in the frame members, however, they may also be simply glued to the outer surface of the frame members. The gasket members must extend outwardly of the frame to such an extent as to compensate for the clearance between screen door insert frame and the standard door frame. It has been found that if each of the gasket members extends outwardly of the frame member to the same extent as the clearance between the screen door insert frame and the standard door frame the frame will be secured adequately. In a preferred embodiment, the gaskets each extend outwardly ¼ inch. A D-shaped foam rubber gasket has been found adequate for the purposes of this invention. As is clear from FIG. 2, the D-shaped foam rubber gaskets have a straight rear wall and a semi-circular curved outer portion extending outwardly of the channels. The rear wall and the curved outer portion form the D-shape. The channels have a straight rear wall, the gasket rear wall being tightly received and abutting the channel rear wall. Foam plastic, e.g. polyurethane and other gasket materials, may also be used.

FIG. 2 also shows the mounting of the screen door frame 14. As seen in phantom lines, the left vertical side of the screen door frame is first inserted into the outer door frame 24. The gasket member 30 is compressed against the door frame 24 and the screen door insert is swung counter clockwise so as to insert the right vertical side of the screen door frame. While the gasket 30 is initially compressed in order to insert the screen door frame either the top or bottom gasket must also be compressed to provide height clearance. The screen door frame is swung until it abuts the outer door stop member 26 at all sides. At that point the handle 22 is released and the gasket members on all four sides reach an equilibrium and should be slightly compressed; thus securing and sealing the screen door insert 14 in its operative position.

Figure 3:
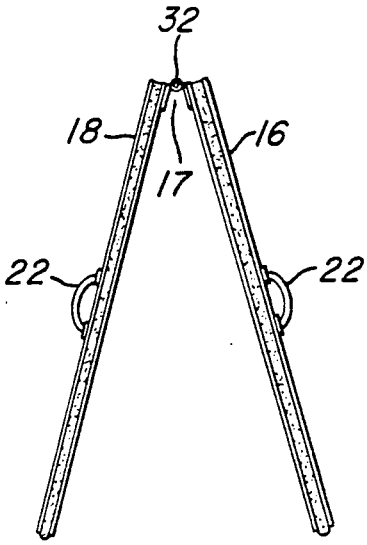
FIG. 3 is a longitudinal cross-section showing the screen door insert in a semi-folded position.

FIG. 3 illustrates a first embodiment of the screen door insert 14 in its folded position. As can be seen, a hinge axis 17 extends horizontally across the screen door insert and a conventional piano hinge 32 connects the upper portion 16 and the lower portion 18. The screen door insert 14 of the first embodiment can thus be folded in half along a horizontal axis for easier and more compact storage.

Figure 4:
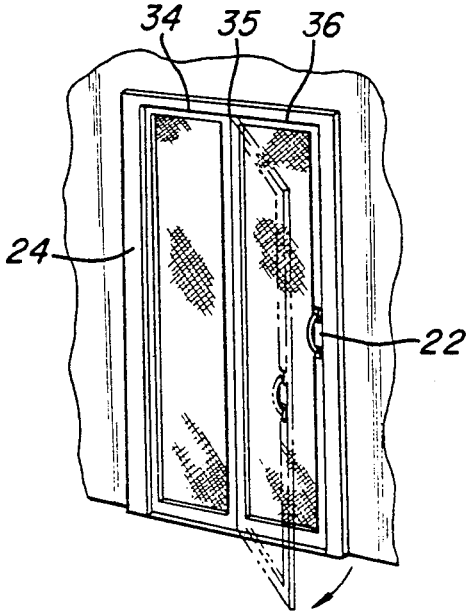
FIG. 4 discloses a second embodiment of the screen door insert that will fold along a longitudinal axis and that can be opened while inserted in the door frame.

FIG. 4 shows a second embodiment of the screen door insert 14 of the present invention. In the second embodiment the screen door insert 14 is also mounted in an outer door frame 24. However, the second embodiment of the screen door insert is hinged along a vertical axis 35 and can be swung open while in its operative position to allow access out of, or entry into, the dwelling place 11. Upon removal of the second embodiment of the screen door insert 14, the right section 36 can be folded over the left section 34 for easier and more compact storage. As will be understood, the embodiment of FIG. 4 may be opened after insertion which may be an advantage in certain applications.

A preferred embodiment of the screen door insert of the present invention has been disclosed. However, this preferred embodiment is not intended to limit the scope of the invention. Several modifications could be envisioned to the disclosed embodiment that would still remain within the intended scope of the disclosed invention. For instance, the frame can be made of aluminum or another material instead of wood. The gasket material could be mounted in a different way or a different material could be used for the gasket member. Also, the disclosed clearance between the screen door insert and the open door frame could be varied.

The intended scope of the present invention can be determined by consideration of the appended claims.

We claim:

1. A screen door insert for mounting in a standard door frame in which the screen door insert is constructed so as to be disposed in abutting relationship with the door stop member of the outer door member; said screen door insert comprising:

a frame with vertically and horizontally extending connected members;

screen material disposed on the interior of the frame formed by said connecting members;

said screen door insert being constructed so as to be useful with a selected standard door frame size;

said screen door frame being formed with a designed clearance so as to be slightly smaller in both the vertical and horizontal dimensions then the selected standard door size;

securing members mounted to both said vertically extending frame members and both said horizontally extending frame members of said frame, said securing members extending outwardly from said frame members;

the sum of the outward extend of the securing members on both said frame members being greater than the designed clearance between the screen door insert frame and the standard door frame size;

said securing members being compressible and resilient so that one of said securing members can be compressed to facilitate mounting of said screen door insert, said screen door insert when mounted having said securing members on both said sides being compressed and thus resiliently holding the screen door insert in place in the standard door frame;

said securing members extend along the entire extend of both said vertically extending frame members and said horizontally extending frame members;

said screen door frame is comprised of wood;

said securing members are D-shaped foam rubber gaskets and are disposed in channels in said frame members;

said D-shaped gasket having a straight rear wall and a semi-circular curved outer portion extending outwardly away from said straight rear wall, said semi-circular curved outer portion extending outwardly of said channels, said channels having straight rear walls, said gasket rear wall being tightly received and abutting said channel rear wall;

said screen door insert is foldable along one of its axes; and said frame being formed from at least two frame elements each having four side frame members interconnected at their ends and forming a rectangular framed opening with screen material connected to said side members and covering said framed opening, said frame elements hingedly connected along one of said side members of each of said at least two frame elements for facilitating the folding of said screened insert.

2. A screen door insert as recited in claim 1, and further in which the designed clearance between the screen door insert and the standard door frame is $\frac{1}{4}$ inch; and wherein said securing members are disposed along the entire sides of both said frame members and each extend $\frac{1}{4}$ inch outwardly of the frame to provide a secure mounting for the screen door frame.

3. A screen door insert as recited in claim 1, in which said screen door insert is foldable along a horizontally extending axis.

4. A screen door insert as recited in claim 3, in which said screen door insert can be operably disposed in a door frame in its folded position.

5. A screen door insert as recited in claim 1, in which said screen door insert is foldable along a vertically extending axis.

6. A screen door insert as recited in claim 1, and further wherein said screen door frame has handles disposed thereon on one vertical frame member.

* * * * *